US006283055B1

(12) United States Patent
Salvetti

(10) Patent No.: US 6,283,055 B1
(45) Date of Patent: Sep. 4, 2001

(54) APPARATUS AND METHOD FOR AUTOMATICALLY FEEDING TUBULAR ARTICLES, PARTICULARLY HOSIERY, TO A SEWING MACHINE ADAPTED TO CLOSE THE TUBULAR ARTICLES AT ONE OF THEIR AXIAL ENDS

(75) Inventor: Sergio Salvetti, Milan (IT)

(73) Assignee: Conti Complett S.p.A., Milan (IT)

( * ) Notice: Subject to any disclaimer, the term of this patent is extended or adjusted under 35 U.S.C. 154(b) by 0 days.

(21) Appl. No.: 09/627,065

(22) Filed: Jul. 27, 2000

(30) Foreign Application Priority Data

Sep. 29, 1999 (IT) ..... MI99A2029

(51) Int. Cl.[7] ..... D05B 33/00; D05B 21/00
(52) U.S. Cl. ..... 112/470.15; 112/475.12
(58) Field of Search ..... 112/470.15, 475.12, 112/470.33, 475.04

(56) References Cited

U.S. PATENT DOCUMENTS 3,738,294 * 6/1973 Christiansen ..... 112/470.15
4,957,051 * 9/1990 Maegawa et al. ..... 112/470.15 X
5,014,634 * 5/1991 Hodges et al. ..... 112/470.15
5,373,977 12/1994 Migliorini Pier et al. .
5,398,626 * 3/1995 Rosso et al. ..... 112/470.15
5,511,501 * 4/1996 Bell et al. ..... 112/470.15

FOREIGN PATENT DOCUMENTS 0 889 153 1/1999 (EP) .

* cited by examiner

*Primary Examiner*—Ismael Izaguirre
(74) *Attorney, Agent, or Firm*—Guido Modiano; Albert Josif; Daniel O'Byrne

(57) ABSTRACT

An apparatus for automatically feeding tubular articles comprising elements for feeding an article, which are adapted to fit an axial end of the article which is provided with a border thicker than at least one adjacent portion of the article on grip means which can be actuated in order to engage within the axial end so as to support the article in a substantially vertical arrangement and in order to produce a spacing of two diametrically opposite regions of the axial end transversely to the axial extension of the article. The apparatus also comprises elements for supporting the article, which form a first slit-like passage arranged substantially horizontally and adapted to receive a portion of the article that is arranged below the border. Elements for tensioning in a downward direction the article inserted in the first slit-like passage are also provided. The supporting elements and the tensioning elements are movable on command in order to insert the portion of the article that lies directly below the border along a second slit-like passage formed by two side-by-side guides for feeding a sewing machine.

The method carried out by the apparatus.

20 Claims, 8 Drawing Sheets

APPARATUS AND METHOD FOR AUTOMATICALLY FEEDING TUBULAR ARTICLES, PARTICULARLY HOSIERY, TO A SEWING MACHINE ADAPTED TO CLOSE THE TUBULAR ARTICLES AT ONE OF THEIR AXIAL ENDS

BACKGROUND OF THE INVENTION

The present invention relates to an apparatus and a method for automatically feeding tubular articles, particularly hosiery, to a sewing machine adapted to close the tubular articles at one of their axial ends.

It is known that the toe of hosiery articles is generally still open when said articles are unloaded from the machine that forms them, and that said hosiery articles must be subjected to subsequent darning or looping of the toe in order to form the finished product.

The darning or looping significantly affects the overall production costs of the hosiery articles, mainly owing to the fact that it requires manual loading of the hosiery articles onto the darning or looping machine.

In order to reduce the production costs, machines which can produce hosiery with the toe already closed have been designed in recent years. However, these machines are more expensive than conventional machines and their production cycle is inevitably longer than that of conventional machines. For these reasons, the advantages achieved with these machines, in terms of hosiery production costs, are not relevant.

Devices have also been provided for mechanically transferring the hosiery article, at the end of the production cycle, from the machine that produces it to a sewing or looping head, by removing from the machine, one loop at a time, the last row of knitting formed, which constitutes the toe of the hosiery article to be closed. These devices allow to achieve very precise sewing or looping of the toe, but they too have the problem of slowing the production of the hosiery knitting machine.

SUMMARY OF THE INVENTION

The aim of the present invention is to solve the above problems, by providing an apparatus and a method for automatically feeding tubular articles, particularly hosiery, to a sewing machine adapted to close the tubular articles at one of their axial ends.

Within the scope of this aim, an object of the invention is to provide an apparatus which can be completely independent, in its operation, of the machine that produces the tubular articles, so as to avoid penalizing even slightly the productivity of said machine.

Another object of the invention is to provide an apparatus which can fully utilize the productive potential of current sewing machines for closing the toe of hosiery or an axial end of tubular articles in general.

Another object of the invention is to provide an apparatus which is highly reliable and precise in feeding the hosiery articles, or tubular articles in general, to the sewing machine.

These and other objects which will become better apparent hereinafter are achieved by an apparatus for automatically feeding tubular articles, particularly hosiery articles, to a sewing machine adapted to close the tubular articles at one of their axial ends, characterized in that it comprises:

means for feeding an article, which are adapted to fit an axial end of the article which is provided with a border which is thicker than at least one adjacent portion of the article on grip means which can be actuated in order to engage within said axial end so as to support said article in a substantially vertical arrangement and in order to produce a spacing of two diametrically opposite regions of said axial end transversely to an axial extension of the article;

means for supporting the article, which form a first slit-like passage arranged substantially horizontally and adapted to receive a portion of the article arranged below said border;

means for tensioning in a downward direction the article inserted in said first slit-like passage, said supporting means and said tensioning means being movable on command in order to insert the portion of said article that lies directly below said border along a second slit-like passage formed by two side-by-side guides for feeding a sewing machine.

BRIEF DESCRIPTION OF THE DRAWINGS

Further characteristics and advantages of the invention will become better apparent from the description of a preferred but not exclusive embodiment of the apparatus according to the invention, illustrated only by way of non-limitative example in the accompanying drawings, wherein.

DESCRIPTION OF THE PREFERRED EMBODIMENTS

Figure 1:
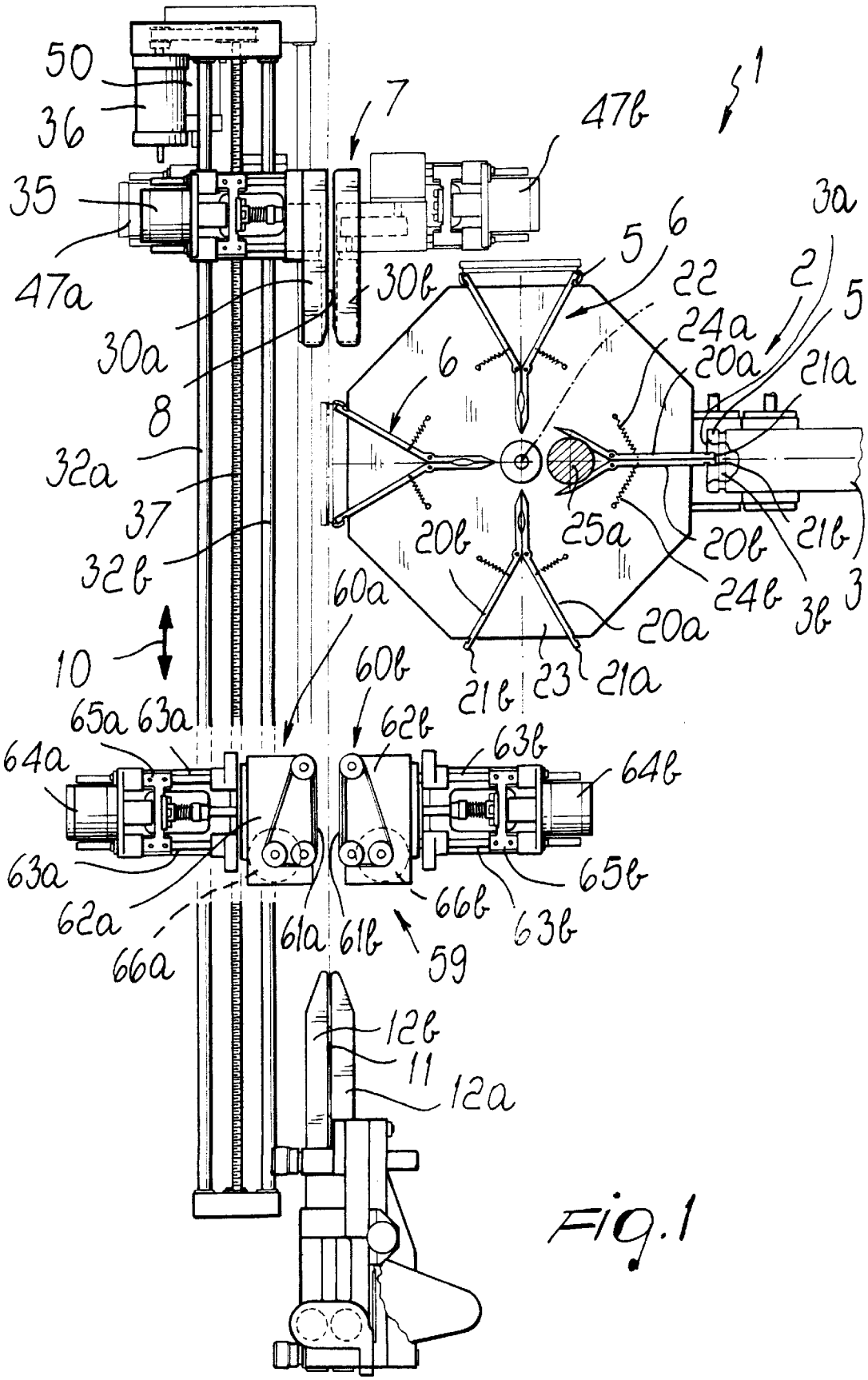
FIG. 1 is a schematic top plan view of the apparatus according to the invention, with some elements removed for the sake of clarity.

With reference to the above figures, the apparatus according to the invention, generally designated by the reference numeral 1, comprises means 2 for feeding an article 3 which are adapted to fit an axial end 3*a* of the article 3, which is provided with a border 5 which is thicker than at least one adjacent portion 3*b* of the article, on grip means 6 which can be actuated so as to engage in the axial end 3*a* of the article 3 in order to support the article substantially vertically and produce a spacing of two diametrically opposite regions of the axial end 3*a* transversely to the axial extension of the article 3.

The apparatus also comprises means 7 for supporting the article 3 which form a first slit-like passage 8 which is arranged substantially horizontally and is adapted to receive a portion of the article that lies below the border 5.

The apparatus further comprises tensioning means 9, which can be actuated so as to tension in a downward direction the article 3 inserted in the first slit-like passage 8 of the supporting means 7.

The supporting means 7 and the tensioning means 9 are movable on command in a direction 10 which is preferably substantially parallel to the length of the first slit-like passage 8, in order to insert the portion 3*b* of the article 3, lying directly below the border 5, along a second slit-like passage 11 which is arranged at a lower level than the first slit-like passage 8 and is preferably aligned with the first slit-like passage 8. The second slit-like passage 11 is formed by a pair of side-by-side feeder guides 12*a* and 12*b* of a conventional sewing machine, not shown for the sake of simplicity.

More particularly, the feeder means 2 comprise a conveyor belt 15 arranged, with its upper portion 16, on a substantially horizontal plane so as to form a supporting and advancement surface for the article 3, which is deposited onto the upper portion 16 of the conveyor belt 15 so that its axial end 3*a*, which is designed to be sewn in order to close it, faces the advancement direction of the upper portion 16 of the conveyor belt 15.

The article 3 can be deposited with the correct orientation on the upper portion 16 of the conveyor belt 15 for example by means of a spreading unit 13 of the type disclosed in Italian patent 1,293,751.

The feeder means 2 also comprise at least one pair of counter-rotating rollers 17*a*, 17*b*, 18*a*, 18*b* which are arranged at the output end of the conveyor belt 15. The rollers 17*a*, 17*b*, 18*a*, 18*b* are arranged so that their axes lie transversely to the advancement direction of the conveyor belt 15 and engage two opposite lateral portions, an upper one and a lower one, of the article 3 arriving from the conveyor belt 15.

Conveniently, as shown, there are two pairs of counter-rotating rollers 17*a*, 17*b*, 18*a*, 18*b* which are arranged sequentially along the direction of advancement of the conveyor belt 15 starting from the output end of said conveyor belt 15. The rollers 17*a*, 17*b* and 18*a*, 18*b* are supported, so that they can rotate about their respective axes, which lie horizontally and are perpendicular to the direction of advancement of the upper portion 16 of the conveyor belt 15, by a supporting structure which is not shown for the sake of simplicity and can be turned about their respective axes so as to cooperate with the conveyor belt 15 in the advancement of the article 3, also stretching said article 3 proximate to its end 3*a* and pushing the article 3 onto the grip means 6.

It should be noted that the rotation of the rollers 18*a* and 18*b* that lie closest to the grip means 6 can be reversed after the axial end 3*a* of the article 3 has moved beyond the rollers 18*a* and 18*b*, so as to cause the axial end 3*a* to open out in order to facilitate the engagement of the grip means 6 inside said axial end 3*a*.

A plate 19 is arranged between the conveyor belt 15 and the rollers 17*a* and 17*b*, lies on a substantially horizontal plane and is designed to support the article 3 in its transfer from the conveyor belt 15 to the rollers 17*a* and 17*b*.

The grip means 6 comprise at least one pair of rods 20*a* and 20*b* which are hinged in a scissors-like configuration and are arranged so that one of their ends 21*a* and 21*b* is directed toward the pair of rollers 18*a* and 18*b*, on the opposite side with respect to the conveyor belt 15. The rods 20*a* and 20*b* can move from a receiving position, in which their ends 21*a* and 21*b* directed toward the pair of rollers 18*a* and 18*b* are moved closer one another, so as to receive around them the axial end 3*a* of the article 3, to an engagement position, in which their ends 21*a* and 21*b* are spaced in order to engage in the axial end 3*a* of the article 3 so as to open out said axial end 3*a* of the article 3.

The pair of rods 20*a* and 20*b* is arranged on a substantially horizontal plane and is rotatable on command about a rotation axis 22 which is substantially vertical, in order to pass from a loading position, in which the pair of rods 20*a* and 20*b* faces, with the ends 21 and 21*b*, the pair of rollers 18*a* and 18*b* on the opposite side with respect to the conveyor belt 15, to an unloading position, in which the pair of rods 20*a* and 20*b* is angularly spaced with respect to the loading position around the rotation axis 22.

Preferably, as shown, a plurality of pairs of rods 20*a* and 20*b* is provided which are fitted on a carousel-like structure 23 which is rotatable on command about the rotation axis 22 in order to cyclically transfer each one of the pairs of rods 20*a* and 20*b* from the loading position to the above-mentioned unloading position and vice versa.

The carousel-like structure 23 is substantially constituted by a plate which is arranged so that its upper face lies on a substantially horizontal plane. The rods 20*a* and 20*b* of the various pairs of rods are hinged, with an intermediate portion of their length, to the upper face of said plate of the carousel-like structure 23. The ends 21*a* and 21*b* of the rods 20*a* and 20*b* protrude from the perimeter of the plate so as to allow the article 3, engaged by the ends 21*a* and 21*b* at the border 5, to be arranged vertically by gravity. Each rod 20*a* and 20*b* is also connected to the plate by means of a corresponding spring 24*a* and 24*b* which produces the rotation of the corresponding rod 20*a* or 20*b*, about its own pivoting axis, in the direction that produces a spacing of the ends 21*a* and 21*b*.

The approach of the ends 21*a* and 21*b* of the rods 20*a* and 20*b*, in contrast with the action of the springs 24*a* and 24*b*, is achieved by wedge-shaped elements 25*a* and 25*b* arranged above the carousel-like structure 23. More particularly, each wedge-shaped element 25*a* and 25*b* is fixed to the lower end of a corresponding shaft 26*a* and 26*b*, which has a vertical axis and is supported, so that it can slide along its axis, by a supporting structure 27. Each shaft 26*a* and 26*b* is also fixed to a block 28*a* and 28*b* which is provided with a female thread in which a threaded shaft engages; said shaft is parallel to the shafts 26*a* and 26*b* and is coaxially connected to the output shaft of a corresponding electric motor 29*a* and 29*b* installed on the supporting structure 27. Thanks to the actuation of the electric motors 29*a* and 29*b*, the screw-and-nut coupling with the corresponding block 28*a* and 28*b* produces the downward translatory motion of the wedge-shaped element 25*a* and 25*b* so as to achieve its engagement between the rods 20*a* and 20*b* or its upward translatory motion so as to achieve the disengagement of the wedge-shaped element 25*a* and 25*b* from the rods 20*a* and 20*b*.

Obviously, the translatory motion of the wedge-shaped elements 25*a* and 25*b* to produce their engagement or disengagement with respect to the rods 20*a* and 20*b* can be achieved through other actuation means, such as for is example mechanical means, hydraulic or pneumatic means, or other conventional actuation means.

In the illustrated embodiment, the rods 20*a* and 20*b*, in the unloading position, are angularly spaced around the rotation axis 22 with respect to the rods 20*a* and 20*b* that lie in the loading position, at an angle of 180°, and there are two wedge-shaped elements 25*a* and 25*b* which can be actuated so as to engage or disengage with respect to the rods 20*a* and 20*b* in the loading position and the rods 20*a* and 20*b* in the unloading position.

The carousel-like structure 23 is actuated, by virtue of conventional mechanical means which are not shown for the sake of simplicity, so as to turn intermittently about the axis 22 in order to make one pair of rods 20*a* and 20*b* face, in each instance, the rollers 18*a* and 18*b*.

The supporting means 7 comprise a pair of blades 30*a* and 30*b* which lie on a horizontal plane and face each other so as to form the first slit-like passage 8 between them.

At least one of the blades 30*a* or 30*b* can move on command toward or away from the other blade 30*b* or 30*a* so as to vary the width of the first slit-like passage 8.

Furthermore, the blades 30*a* and 30*b* can move together parallel to the longitudinal extension of the first slit-like passage 8 in order to convey the article 3, supported by the blades 30*a* and 30*b*, in the direction 10.

More particularly, the blade 30*a* is fixed to a frame 31 which is slidingly fitted on a pair of guides 32*a* and 32*b* which run parallel to the longitudinal extension of the first slit-like passage 8, i.e., parallel to the direction 10. The other blade 30*b* is instead rigidly connected to horizontal bars 33 which are supported, so that they can slide longitudinally, by the frame 31 and lie at right angles to the longitudinal extension of the first slit-like passage 8. The sliding of the bars 33 with respect to the frame 31, in order to achieve the approach or spacing of the blade 30*b* with respect to the blade 30*a*, can be achieved in a manner similar to the one described with reference to the wedge-shaped elements 25*a* and 25*b*, i.e., by providing a block 34 which is fixed to at least one of the bars 33 and by providing, inside the block 34, a female thread whose axis is parallel to the bars 33 and with which a threaded shaft engages which is parallel to the bars 33 and is connected to the output shaft of an electric motor 35. The actuation of the bars 33 and therefore of the blade 30*b* can of course be achieved with other conventional means.

In operating conditions, i.e., during the support of the article 3, the first slit-like passage 8 is narrower than the overall thickness of the border 5 provided at the axial end 3*a* of the article 3. The increase in the width of the first slit-like passage 8, achieved by virtue of the spacing of the blade 30*b* from the blade 30*a*, is utilized to facilitate the insertion of the article 3 between the blades 30*a* and 30*b* and to facilitate its disengagement from the blades 30*a* and 30*b*.

The sliding of the frame 31 along the guides 32*a* and 32*b* also can be achieved by means of an electric motor 36 which is supported by a fixed frame and is connected, by means of its output shaft, to a threaded shaft 37 which is supported so that it can rotate about its own axis, which lies parallel to the guides 32*a* and 32*b*, and engages in a female thread 38 formed in a portion of the frame 31 or in a block which is rigidly coupled to the frame 31.

The tensioning means 9 comprise two counter-rotating rollers 40*a* and 40*b* which are arranged so that their axes 41*a* and 41*b* are substantially horizontal and parallel to the longitudinal extension of the first slit-like passage 8. The rollers 40*a* and 40*b* are arranged below the blades 30*a* and 30*b* and are movable on command toward or away from each other in order to engage or disengage with respect to two opposite lateral regions of the article 3 which is supported vertically by the blades 30*a* and 30*b*.

More particularly, the rollers 40*a* and 40*b* are supported, so that they can rotate about their respective axes, by L-shaped elements 42*a* and 42*b* on which respective electric motors 43*a* and 43*b* are fitted. The motors are connected, by virtue of their output shafts, respectively to the roller 40*a* and to the roller 40*b* and can be actuated so as to produce the rotation of the rollers 40*a* and 40*b* in opposite directions.

The L-shaped elements 42*a* and 42*b* are respectively fixed to bars 44*a* and 44*b* which are arranged at right angles to the longitudinal extension of the first slit-like passage 8. The bars 44*a* and 44*b* are also supported, so that they can slide longitudinally, by a frame 45 which is in turn fitted, so that it can slide, on a pair of guides 46*a* and 46*b* which run parallel to the guides 32*a* and 32*b*.

The approach or spacing of the rollers 40*a* and 40*b* can be achieved by virtue of respective electric motors 47*a* and 47*b* fitted on the frame 45 and connected, by means of their output shafts, to threaded shafts which are orientated parallel to the bars 44*a* and 44*b* and engage female threads formed in blocks 48*a* and 48*b* respectively connected to the bars 44*a* and to the bars 44*b*, so that the actuation of the electric motors 47*a* and 47*b* in one direction of rotation or in the opposite direction of rotation causes the translatory motion, in a longitudinal direction, of the bars 44*a* and 44*b* with respect to the frame 45 in one direction or in the opposite direction.

The translatory motion of the frame 45 along the guides 46*a* and 46*b* also can be achieved by virtue of an electric motor 50 supported by a fixed frame and connected, by means of its output shaft, to a threaded shaft 49 which is supported, so that it can rotate about its own axis which lies parallel to the guides 46*a* and 46*b*, by the fixed frame and engages a female thread 51 formed in a portion of the frame 45 or in a block which is rigidly coupled to the frame 45.

It should be noted that the frame 45 can also be rigidly coupled to the frame 31 by providing, for the simultaneous translatory motion of the frames 31 and 45 in a direction which is parallel to the longitudinal extension of the first slit-like passage 8, a single pair of guides, such as for example the guides 32*a* and 32*b* or the guides 46*a* and 46*b*, and by using a single electric motor, for example the motor 36 or the motor 50, to perform the translatory motion.

Advantageously, the apparatus according to the invention also comprises means 59 for orientating the article 3 while said article 3 is supported by the supporting means 7. The orientating means 59 are adapted to turn the article 3 about its own axis in order to correctly orientate article 3 before its transfer to the sewing machine.

The orientating means 59 comprise a pair of narrow belts 60*a* and 60*b* which face each other with a portion 61*a* and 61*b*. The portions 61*a* and 61*b* of the belts 60*a* and 60*b* face, on opposite sides, an imaginary vertical plane which is aligned with the first slit-like passage 8, and are arranged at such a height as to lie directly above the blades 30*a* and 30*b* when the blades 30*a* and 30*b*, as a consequence of their translatory motion in the direction 10, lie between the carousel-like structure 23 and the pair of feeder guides 12*a* and 12*b* of the sewing machine.

The narrow belts 60*a* and 60*b* are movable on command toward or away from each other so as to engage or disengage, with their facing portions 61*a* and 61*b*, two opposite lateral regions of the article 3 supported in a vertical arrangement by the supporting means 7. Each narrow belt 60*a* and 60*b* is in fact fitted on a supporting element 62*a* and 62*b* fixed to guiding bars 63*a* and 63*b* which lie at right angles to the longitudinal extension of the first slit-like passage 8 and are supported, so that they can slide longitudinally, by a fixed frame. The movement of the supporting elements 62*a* and 62*b* toward or away from each other can be achieved by virtue of electric motors 64*a* and 64*b* fitted on the fixed structure and connected, by means of their output shaft, to a corresponding threaded shaft which is parallel to the bars 63*a* and 63*b* and engages a female thread formed inside a block 65*a* and 65*b* which is rigidly coupled to the bars 63*a* and to the bars 63*b* respectively.

The approach or spacing of the narrow belts 60*a* and 60*b* can of course also be achieved with other conventional actuation means.

The actuation of the narrow belts 60*a* and 60*b*, which can be achieved by virtue of corresponding electric motors 66*a* and 66*b* fitted respectively on the supporting element 62*a* and on the supporting element 62*b* and connected, by means of their output shafts, to one of the pulleys that support the corresponding narrow belt 60*a* or 60*b*, is performed so that the two facing portions 61*a* and 61*b* of the narrow belts 60*a* and 60*b* move in opposite directions.

The orientating means 59 also comprise two swords 70*a* and 70*b* which are arranged substantially vertically above the narrow belts 60*a* and 60*b* between the facing portions 61*a* and 61*b* of the narrow belts. The swords 70*a* and 70*b* can move on command in a substantially vertical direction in order to enter, with their lower end, the axial end 3*a* of the article with the border 5 or slide out of the axial end of the article 3. At least one of the swords 70*a* or 70*b* is movable on command toward or away from the other sword 70*b* or 70*a* in a direction which is substantially parallel to the longitudinal extension of the first slit-like passage 8, in order to engage or disengage in the axial end 3*a* of the article 3 with the border 5 and in order to produce a slight tensioning of the axial end 3*a* of the article 3 from the inside outwards.

The sword 70*a* is fixed to a supporting element 71, which is fixed to a pair of vertical guiding bars 72*a* and 72*b* supported by a fixed structure 73 so that they are longitudinally slideable.

The sword 70*b* also is supported by the supporting element 71 and is slideable along horizontal guides 74 which are fixed to the supporting element 71 and are arranged at right angles to the longitudinal extension of the first slit-like passage 8.

An electric motor 75 is fixed to the supporting element 71 and is connected, by means of its output shaft, to a threaded shaft 76 lying parallel to the guides 74 and engages in a female thread formed in the body of the sword 70*b* or in a block which is fixed thereto so that an actuation of the electric motor 75 causes the translatory motion of the sword 70*b* along the guides 74 towards or away from the sword 70*a*, depending on the direction of the rotation imparted to the threaded shaft 76.

Another electric motor 77 is also associated with the fixed structure 73 and is connected, by virtue of its output shaft, to a threaded shaft 78 which lies parallel to the bars 72*a* and 72*b* and engages a female thread formed in a block 79, which is rigidly coupled to the bars 72*a* and 72*b*, so that an actuation of the electric motor 77 causes a translatory motion of the bars 72*a* and 72*b* longitudinally with respect to the fixed structure 73 and thus lifts or lowers the swords 70*a* and 70*b*, depending on the direction of the rotation imparted to the threaded shaft 78.

Conveniently, proximate to the orientating means 60 sensor means 80 are provided which are capable of detecting at least one reference region 81 arranged on the outer side of the border 5 of the axial end 3*a* of the article. The sensor means 80 are operatively connected to the motors 66*a* and 66*b* that drive the narrow belts 60*a* and 60*b* so as to exclude or interrupt the actuation of the narrow belts when the reference region 81 is detected by the sensor means 80.

The reference region 81 can be constituted by a band or other reference which is provided on the outer side of the border 5 of the end 3*a* of the article 3 and is optically detectable with respect to the remaining part of the border 5, and the sensor means 80 can be constituted by a photocell 82 capable of detecting said band or other optical reference.

For the sake of completeness in description, it should be noted that the apparatus is provided with other means for detecting the position of the article 3 in order to check and coordinate the operation of the various elements that compose the apparatus. In greater detail, downstream of the rollers 18*a* and 18*b* along the direction of the advancement of the article 3 imparted by the conveyor belt 15 and by the rollers 17*a* and 17*b*, 18*a* and 18*b* a photocell 83 is provided which is capable of detecting the arrival of the axial end 3*a* of the article 3 on the end 21*a* and 21*b* of the rods 20*a* and 20*b*. The photocell 83 is operatively connected to the motor, not shown for the sake of simplicity, that drives the conveyor belt 15, and to the motors that drive the rollers 17*a* and 17*b*, 18*a* and 18*b*, so as to interrupt the advancement of the article 3 as soon as its axial end 3*a* is fitted onto the end 21*a* and 21*b* of the rods 20*a* and 20*b* in the loading position. The photocell 83 is also operatively connected to the motor 29*a* that drives the wedge-shaped element 25*a*.

Sensor means, such as for example a photocell 84, are also provided below the carousel-like structure 23; the photocell detects the presence of an article 3 which is supported by the rods 20*a* and 20*b* when they are in the unloading position. The photocell 84 is operatively connected to the motors 36 and 50 that move the supporting means 7 and the tensioning means 9.

For the sake of completeness in description, it should be noted that the rollers 17*a* and 17*b*, as well as the rollers 18*a* and 18*b*, are movable on command towards or away from each other thanks to actuation means similar to those described with reference to the rollers 40*a* and 40*b*, or thanks to conventional actuation means, so as to engage above and below the article 3 arranged on a substantially horizontal plane on the portion 16 of the conveyor belt 15, or so as to allow the removal of the article 3 by the rods 20*a* and 20*b* in their transfer from the loading position to the unloading position.

The operation of the apparatus according to the invention is as follows.

The article 3 which is to be sewn in order to close one of its axial ends is prepared, on the machine that produces it, so that the border 5 is at its axial end 3*a* that must be sewn. The border 5 is thicker at least than the adjacent portion 3*b*, which is preferably knitted with a reduced thickness and with a very elastic thread, such as a thread known commercially by the trademark Helanca or other material having high elasticity. During the knitting of the border 3*a*, a band which is optically contrasting with respect to the remaining part of the border 5 is formed, at least on the outer side of the border, for example by means of a patterning method which is conventional in hosiery knitting machines.

Both the border 5 and the portion 3*b* are to be removed during sewing.

Figure 2:
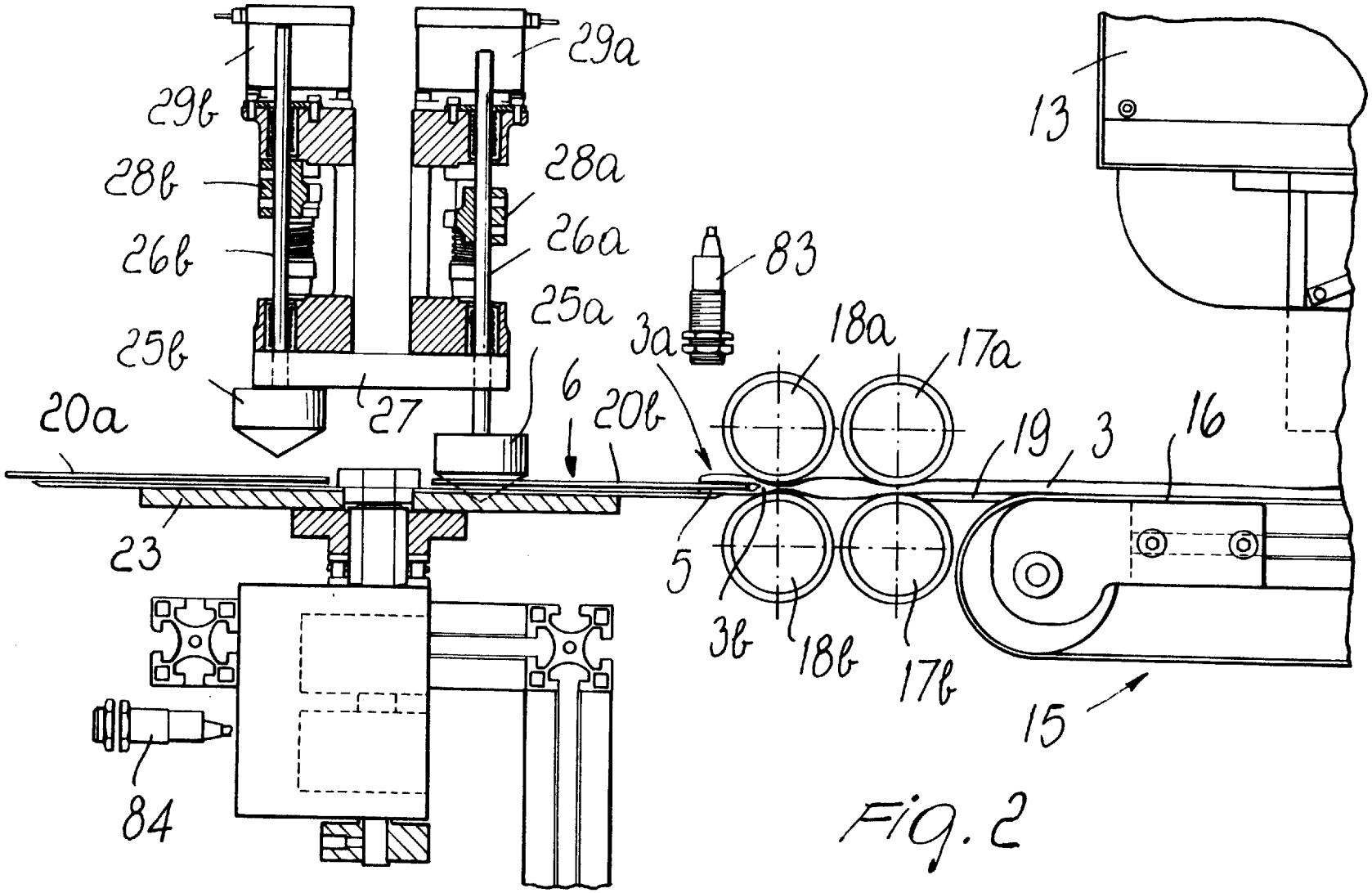
FIG. 2 is a partially sectional front elevation view of a detail of FIG. 1, related to the article feeder means and grip means.

The article 3, which is spread out longitudinally, inside out or not according to the requirements, is unloaded onto the upper portion 16 of the conveyor belt 15 so that its axial end 3*a* faces the advancement direction of the upper portion 16 of the conveyor belt 15. The actuation of the conveyor belt 15 causes the insertion of the article 3, starting from its axial end 3*a*, between the rollers 17*a* and 17*b* and then between the rollers 18*a* and 18*b*, which cooperate with the conveyor belt 15 in causing the article 3 to advance until the axial end 3*a* lies around the ends 21*a* and 21*b* of a pair of rods 20*a* and 20*b* which lie in the loading position, i.e., face the rollers 18*a* and 18*b* with their ends 21*a* and 21*b* arranged close. It should be noted that the speed and direction of the rotation of the rollers 18*a* and 18*b* can be conveniently diversified with respect to those of the rollers 17*a* and 17*b*, so as to open out the end 3*a* in order to facilitate the fitting of said end 3*a* on the ends 21*a* and 21*b* of the rods 20*a* and 20*b* that face the rollers 18*a* and 18*b* (FIGS. 1 and 2).

The arrival of the axial end 3*a* on the ends 21*a* and 21*b* of the rods 20*a* and 20*b* is detected by the photocell 83, which interrupts the actuation of the conveyor belt 15 and of the rollers 17*a* and 17*b*, 18*a* and 18*b* and causes the actuation of the electric motor 29, which raises the wedge-shaped element 25*a*, which was engaged with the rods 20*a* and 20*b*, so as to allow the springs 24*a* and 24*b* to move apart the ends 21*a* and 21*b* of the rods 20*a* and 20*b* inserted in the end 3*a* of the article. The spacing of the ends 21*a* and 21*b* of the rods 20*a* and 20*b* achieves their engagement with two diametrically opposite regions of the axial end 3*a* of the article 3, also tensioning the border 5 from the inside outwards.

It should be noted that the tensioning of the article from the inside outwards at the border 5 also flattens the article at least proximate to the axial end 3*a*.

At this point, the rollers 17*a* and 17*b* and the rollers 18*a* and 18*b* are spaced and the carousel-like structure 23 is turned about the axis 22 so that the rods 20*a* and 20*b* remove the article 3 from the rollers and from the conveyor belt 15, while another pair of rods 20*a* and 20*b* is arranged so that its ends 21*a* and 21*b* face the rollers 18*a* and 18*b*. The overlying wedge-shaped element 25 acts on said other rods and causes the approach of their ends 21*a* and 21*b* so as to allow said ends to receive the axial end 3*a* of a new article 3.

Figure 3:
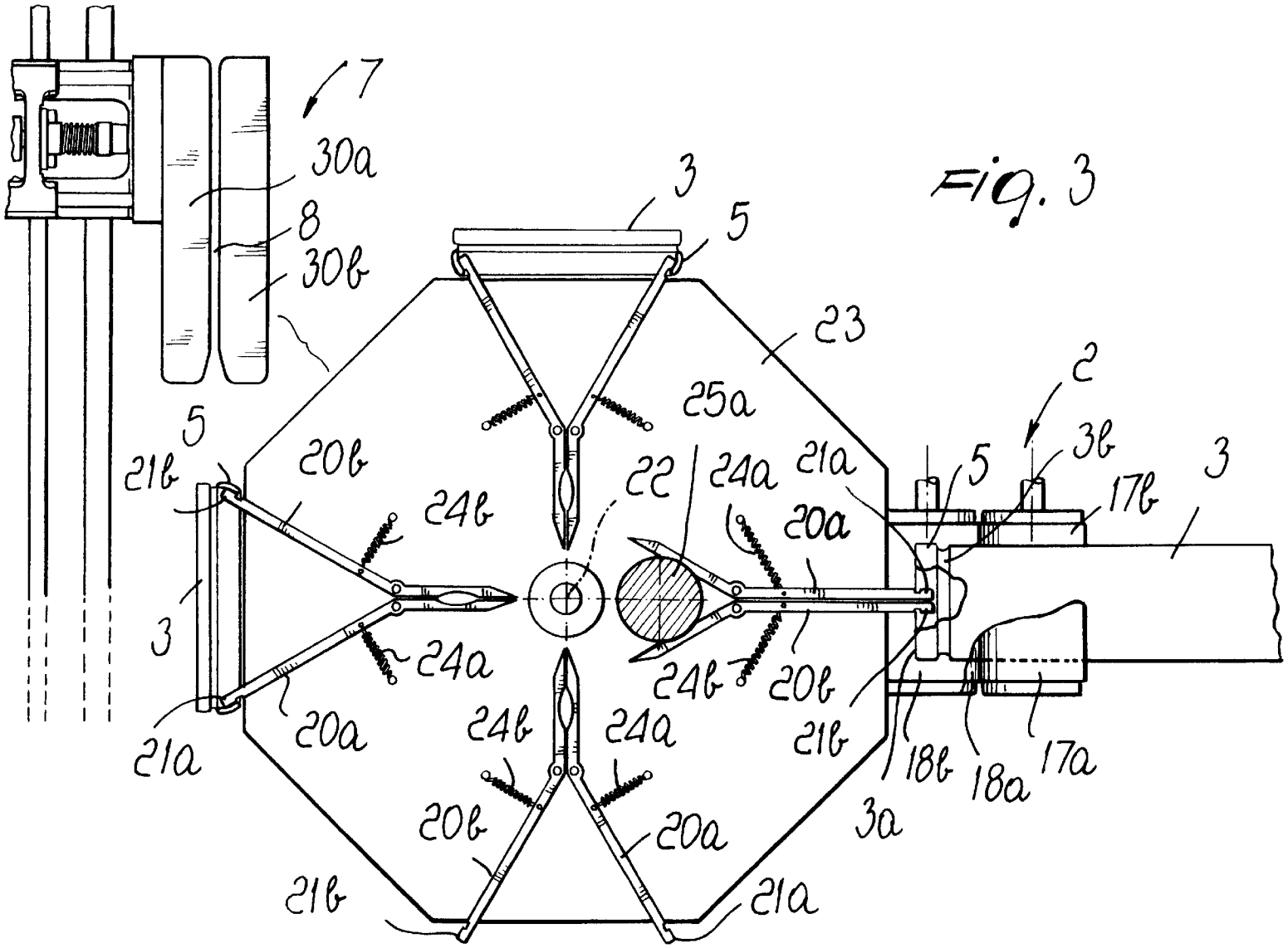
FIG. 3 is an enlarged-scale view of a detail of FIG. 1, again related to the article feeder means and grip means, also showing the article supporting means.

Thanks to a subsequent rotation of the carousel-like structure 23 about the axis 22, a pair of rods 20*a* and 20*b* is arranged in the unloading position, with the article 3 supported vertically with the border 5 still engaged by the ods 20*a* and 20*b* (FIG. 3).

In the unloading position, the rods 20*a* and 20*b* support, by engagement with the border 5, the article 3 in a substantially vertical position on a plane which is aligned with the first slit-like passage 8 formed by the blades 30*a* and 30*b*, which are spaced from the article 3 on the opposite side with respect to the feeder guides 12*a* and 12*b* of the sewing machine.

Figure 4:
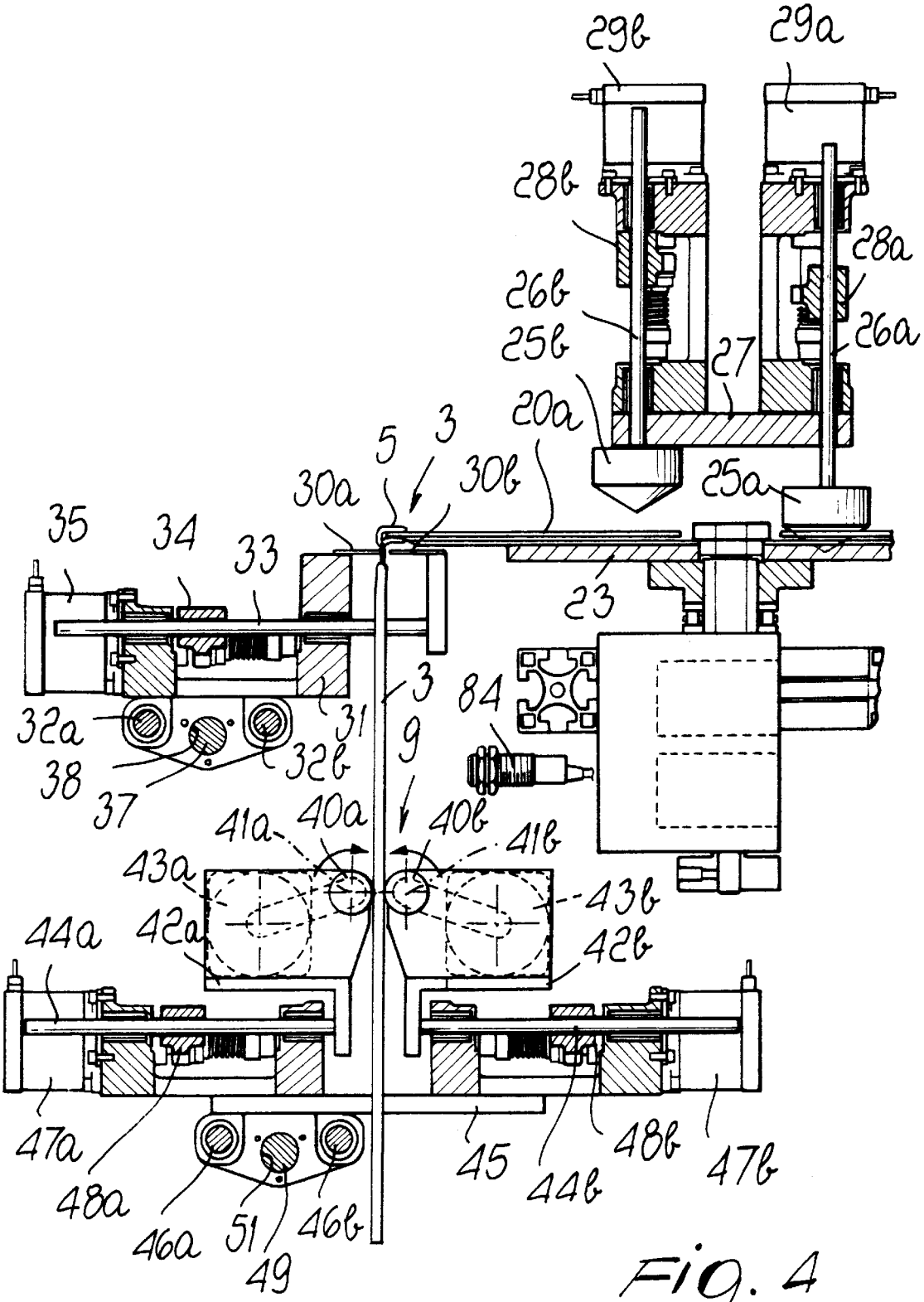
FIGS. 4 and 5 are partially sectional front elevation views of the passage of the article from the grip means to the supporting means, with the intervention of the tensioning means.

The arrival of the article 3 in this position is detected by the photocell 84, which actuates the motors 36 and 50 so as to cause the advancement of the blades 30*a* and 30*b* toward the article 3 and thus cause the insertion of the article 3 between the blades 30*a* and 30*b* inside the first slit-like passage 8 (FIG. 4).

During their advancement, the blades 30*a* and 30*b* are appropriately spaced so as to make the insertion of the article in the first slit-like passage 8 easier and more reliable.

Simultaneously with the blades 30*a* and 30*b*, also the rollers 40*a* and 40*b* are arranged on two opposite sides of the article 3 in a region located below the blades 30*a* and 30*b*.

In order to facilitate the insertion of the article between the rollers 40*a* and 40*b* following the movement of said rollers 40*a* and 40*b* in the direction 10, the rollers 40*a* and 40*b* are appropriately moved apart during this movement.

Figure 5:
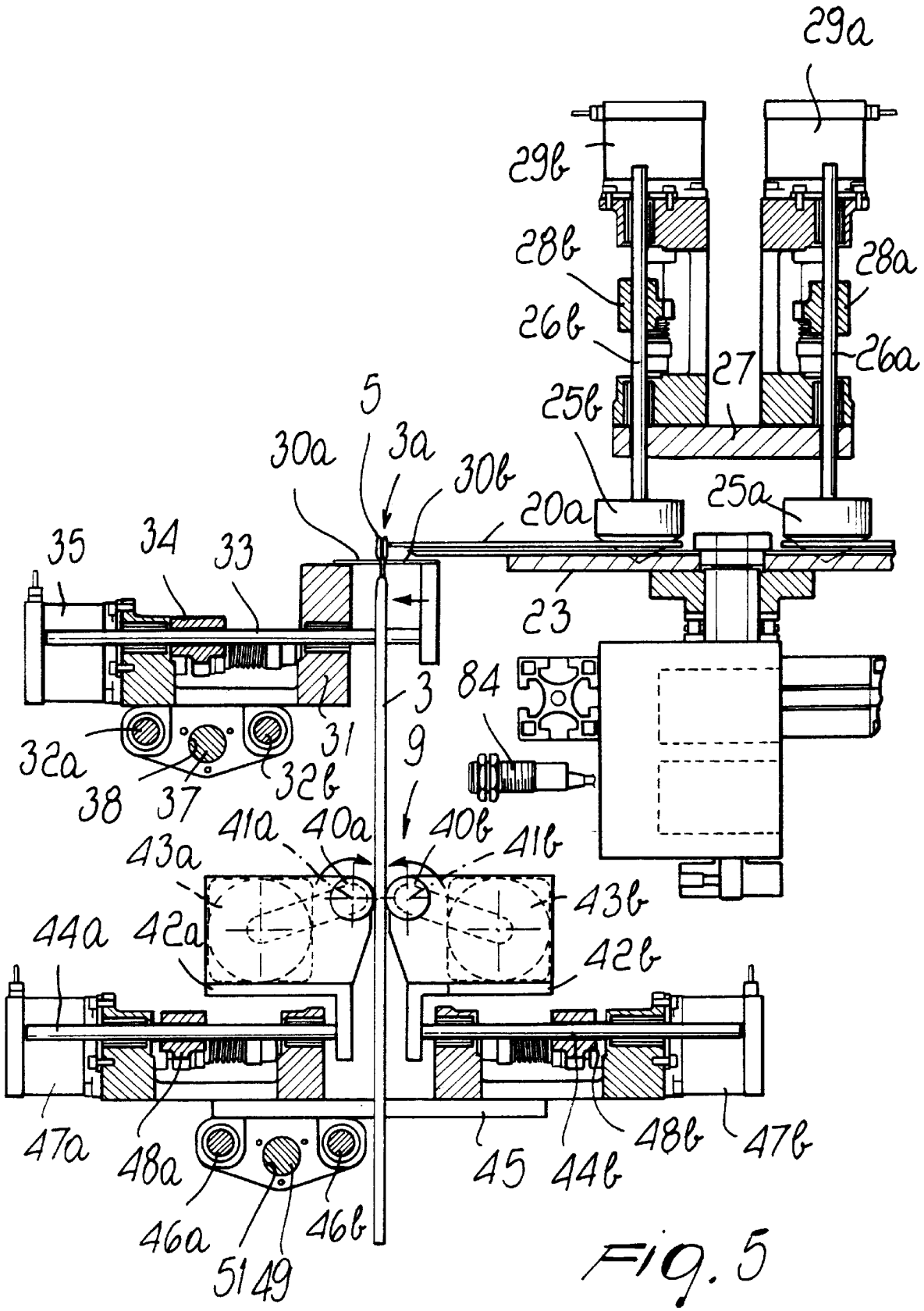

At this point the rollers 40*a* and 40*b* are moved closer one another thanks to the actuation of the motors 47*a* and 47*b*, and the blades 30*a* and 30*b* are also moved closer so that the first slit-like passage 8 is narrower than the overall thickness of the border 5. The wedge-shaped element 25*b* is lowered so as to cause the approach of the ends 21*a* and 21*b* of the rods 20*a* and 20*b*, and the rollers 40*a* and 40*b* are actuated, tensioning the article 3 in a downward direction, causing the disengagement of the border 5 from the rods 20*a* and 20*b*, and causing the border 5 to rest on the upper edges of the blades 30*a* and 30*b* that delimit the first slit-like passage 8 (FIG. 5).

Figure 6:
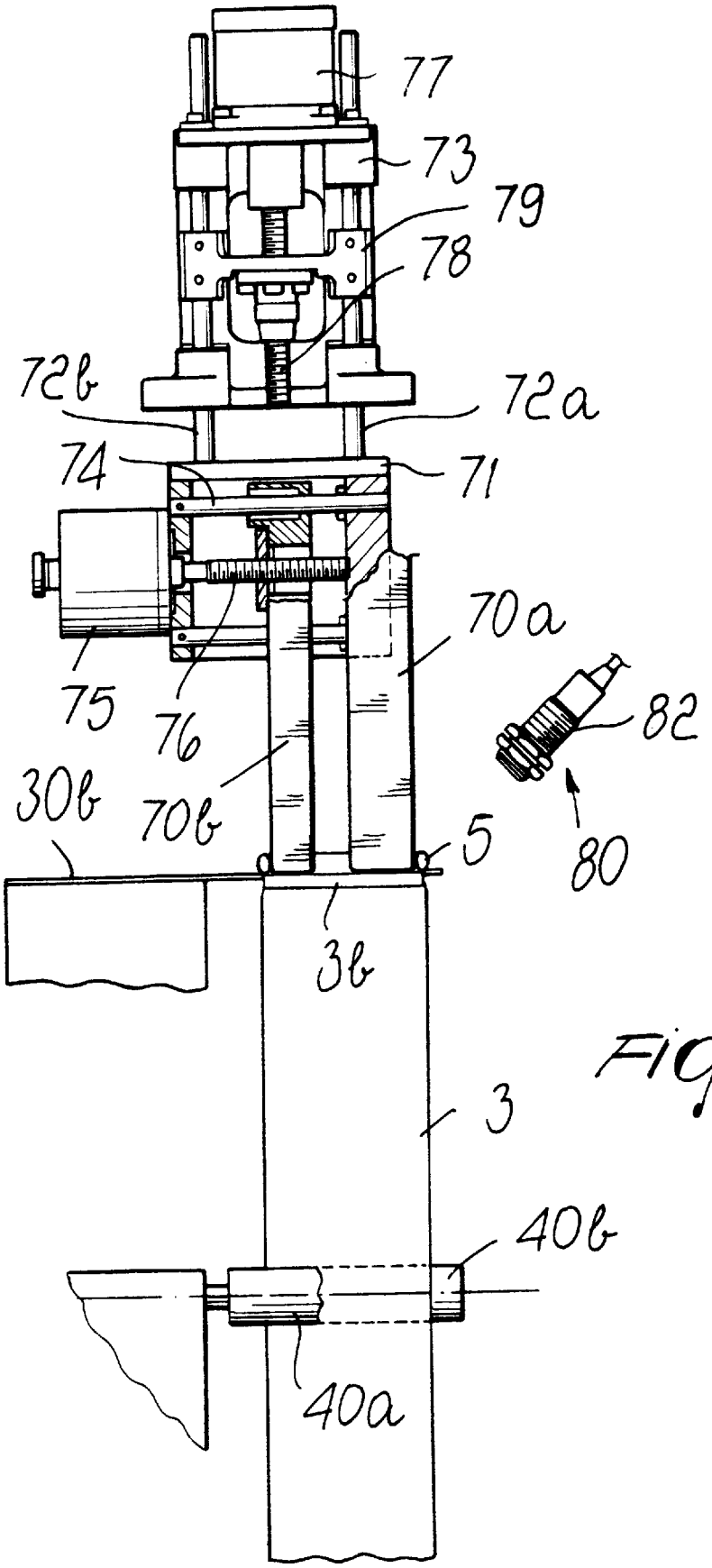
FIGS. 6 and 7 are partially sectional lateral elevation views of other elements of the apparatus according to the invention for turning the article about its own axis.
Figure 7:
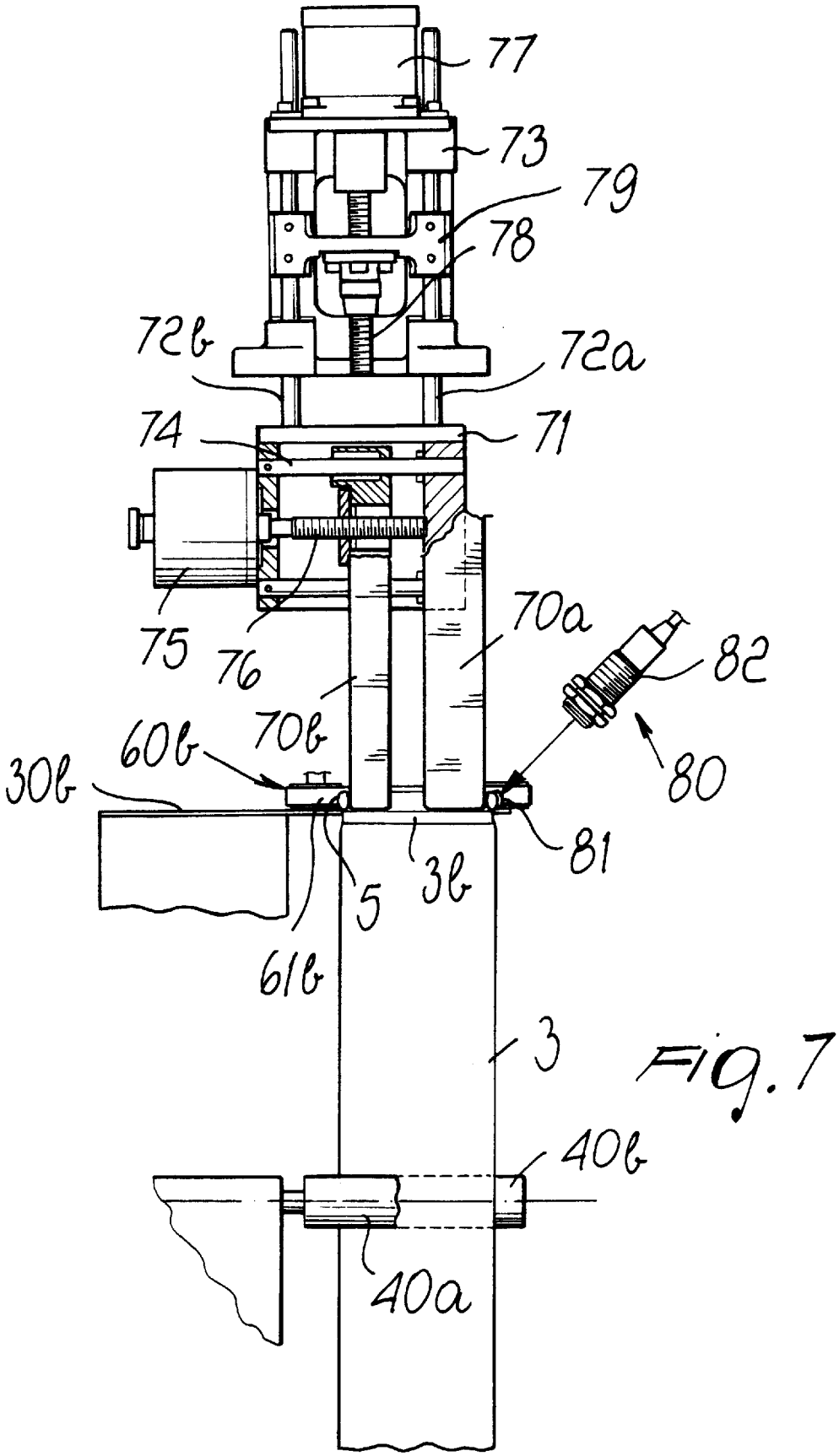

At this point, thanks to the actuation of the motors 36 and 50, the blades 30*a* and 30*b* and the rollers 40*a* and 40*b* are again moved in the direction 10 until the article lies, with its border 5, between the narrow belts 60*a* and 60*b*, which are spaced indeed to facilitate the insertion of the border 5 between them. The swords 70*a* and 70*b*, which are arranged above the narrow belts 60*a* and 60*b* so that the sword 70*b* is adjacent to the sword 70*a*, are inserted with their lower end in the border 5. The rollers 40*a* and 40*b* are moved apart, and the sword 70*b* is moved away from the sword 70*a* thanks to the actuation of the motor 75, so as to slightly tension the border 5 (FIG. 6). The narrow belts 60*a* and 60*b*, thanks to the actuation of the motors 64*a* and 64*b*, are moved closer, so that their portions 61*a* and 61*b* engage two opposite lateral regions of the border 5. At this point the motors 66*a* and 66*b* are actuated, causing the translatory motion of the portions 61*a* and 61*b* of the narrow belts 60*a* and 60*b* in opposite directions, so as to produce a rotation of the article 3 about its own axis with respect to the swords 70*a* and 70*b* until the region 81 provided on the outer side of the is border 5 is detected by the photocell 82 (FIG. 7).

The detection of the region 81 by the photocell 82 causes the narrow belts 60*a* and 60*b* to stop, and the article is thus orientated correctly for the subsequent sewing operation.

It should be noted that if the article does not need to be orientated in a preset manner with respect to the sewing machine, for example in the case of a hosiery article which is not shaped at the heel and at the toe, the orientating means 59 can be omitted or not used.

Figure 8:
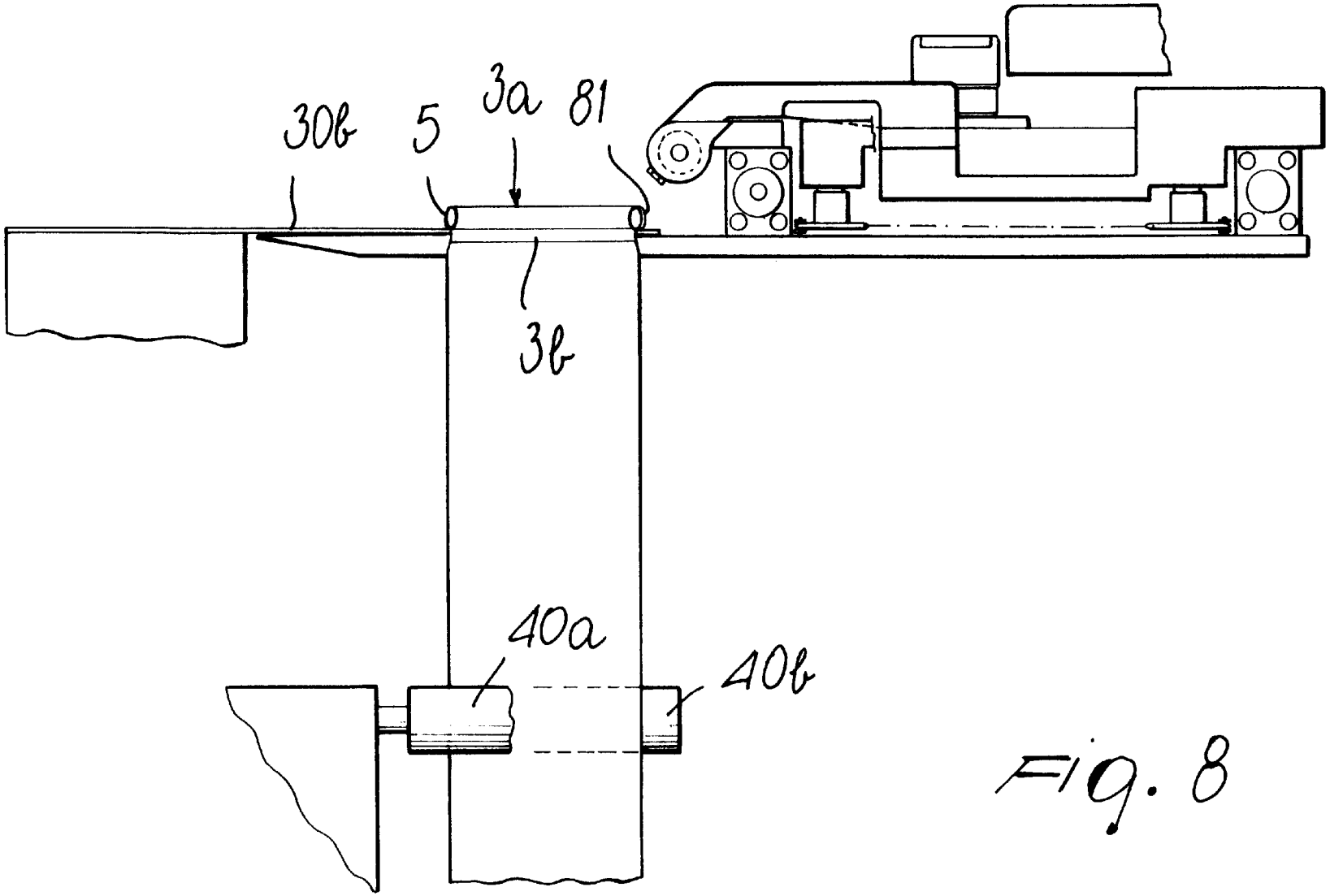
FIG. 8 is a partially sectional lateral elevation view of the transfer of the article from the supporting means to the feeder guides of a sewing machine.

After the article has been orientated correctly, the narrow belts 60*a* and 60*b* are moved apart again and the swords 70*a* and 70*b* are raised so as to disengage from the border 5, while the rollers 40*a* and 40*b* are again engaged with the article 3 and actuated so as to tension in a downward direction said article 3, which is still supported by the blades 30*a* and 30*b*. Said downward tensioning causes the assured and precise resting of the border 5 on the blades 30*a* and 30*b* and elongates the rows of knitting of the portion 3*b*, with a consequent increase in the height of said portion. At this point, the motors 36 and 50 are actuated again, causing a further advancement of the blades 30*a* and 30*b* and of the rollers 40*a* and 40*b* until the article is inserted, with the portion 3*b* located directly below the border 5, in the second slit-like passage 11 between the pair of feeder blades 12*a* and 12*b* of the sewing machine (FIG. 8).

It should be noted that the portion 3*b* of the article is inserted in the second slit-like passage 11 while the article is still tensioned downwards, and therefore insertion is easy and precise.

The blades 30*a* and 30*b* are then moved apart, so as to allow the border 5 to rest on the blades 12*a* and 12*b*.

The rollers 40*a* and 40*b* are then moved apart, so as to disengage from the article 3, and the motors 36 and 50 are actuated so as to return the blades 30*a* and 30*b* and the rollers 40*a* and 40*b* to the initial position shown in FIG. 1.

Once the article 3 has been arranged on the feeder guides 12*a* and 12*b*, it is moved by advancement means, not shown, with which the guides 12*a* and 12*b* are equipped, and is fed to the sewing machine, which closes the axial end 3*a* of the article 3, removing the border 5 and the portion 3*b* in a per se known manner.

In practice it has been observed that the apparatus according to the invention fully achieves the intended aim, since it allows to automatically feed tubular articles, particularly hosiery, to a sewing machine adapted to close the tubular articles at one of their axial ends without however penalizing in any way the productive potential of the machine that produces the tubular article.

The apparatus thus conceived is susceptible of numerous modifications and variations, all of which are within the scope of the appended claims; all the details may furthermore be replaced with other technically equivalent elements.

In practice, the materials used, as well as the dimensions, may be any according to requirements and the state of the art.

The disclosures in Italian Patent Application No. M199A002029 from which this application claims priority are incorporated herein by reference.

What is claimed is:

1. An apparatus for automatically feeding tubular articles, particularly hosiery articles, to a sewing machine adapted to close the tubular articles at one of their axial ends, comprising:

means for feeding an article, which are adapted to fit an axial end of the article which is provided with a border which is thicker than at least one adjacent portion of the article on grip means which can be actuated in order to engage within said axial end so as to support said article in a substantially vertical arrangement and in order to produce a spacing of two diametrically opposite regions of said axial end transversely to an axial extension of the article;

means for supporting the article, which form a first slit-like passage which is arranged substantially horizontally and is adapted to receive a portion of the article that is arranged below said border;

means for tensioning in a downward direction the article inserted in said first slit-like passage, said supporting means and said tensioning means being movable on command in order to insert the portion of said article that lies directly below said border along a second slit-like passage formed by two side-by-side guides for feeding a sewing machine.

2. The apparatus according to claim 1, wherein said second slit-like passage is aligned with said first slit-like passage and is arranged at a lower height than said first slit-like passage, and wherein said supporting means and said tensioning means are movable on command in a direction parallel to said first slit-like passage in order to insert the portion of said article that lies directly below said border along said second slit-like passage.

3. The apparatus according to claim 1, wherein said feeder means comprise a conveyor belt which forms, with one of its portions, a supporting and advancement surface for the article, which is orientated so that said axial end faces the advancement direction of the conveyor belt, said feeder means also comprising at least one pair of counter-rotating rollers arranged at the output end of said conveyor belt, said rollers being arranged so that their axes lie transversely to the advancement direction of said conveyor belt and engaging two opposite lateral portions of the article arriving from said conveyor belt.

4. The apparatus according to claim 3, wherein said conveyor belt is arranged so that its portion designed to receive the article is substantially horizontal, said counter-rotating rollers being also arranged so that their axes are substantially horizontal.

5. The apparatus according to claim 4, wherein said at least one pair of counter-rotating rollers comprises at least two pairs of counter-rotating rollers which are arranged sequentially along the advancement direction of said conveyor belt starting from the output end of said conveyor belt.

6. The apparatus according to claim 3, wherein said grip means comprise at least one pair of rods which are hinged in a scissors-like fashion and can face, with one of their ends, said at least one pair of counter-rotating rollers on the opposite side with respect to said conveyor belt, said rods being movable from a receiving position, in which their ends directed toward said at least one pair of counter-rotating rollers are closer in order to receive around them said axial end of the article, to an engagement position, in which the ends of said rods that are directed toward said at least one pair of counter-rotating rollers are spaced in order to engage said axial end of the article and open out said axial end of the article.

7. The apparatus according to claim 6, wherein said at least one pair of rods is arranged on a substantially horizontal plane.

8. The apparatus according to claim 6, wherein said at least one pair of rods are rotatable on command about a substantially vertical axis of rotation in order to pass from a loading position, in which the rods face, with said ends, said at least one pair of counter-rotating rollers on the opposite side with respect to said conveyor belt, to an unloading position, in which said pair of rods is angularly spaced from said loading position around said rotation axis.

9. The apparatus according to claim 8, wherein said at least one pair of rods comprises a plurality of pairs of rods mounted on a carousel-like structure which can rotate on command about said axis of rotation in order to cyclically move each one of said pairs of rods from said loading position to said unloading position and vice versa.

10. The apparatus according to claim 1, wherein said supporting means comprise a pair of blades which face each other on a substantially horizontal plane and form, between them, said first slit-like passage which, in operating conditions, is narrower than the overall thickness of said border; said pair of blades being movable on command in a direction substantially parallel to the longitudinal extension of said first slit-like passage for the insertion of the article in said first slit-like passage or for the extraction of the article from said first slit-like passage and for the conveyance of said article.

11. The apparatus according to claim 10, wherein said blades are movable on command towards or away from each other in order to vary the width of said first slit-like passage.

12. The apparatus according to claim 1, wherein said tensioning means comprise a pair of counter-rotating rollers arranged so that their axes are substantially horizontal and are orientated parallel to the longitudinal extension of said first slit-like passage; said pair of counter-rotating rollers of the tensioning means being arranged below said supporting means and being engageable with two opposite lateral regions of the article supported by said supporting means.

13. The apparatus according to claim 12, wherein the rollers of said pair of counter-rotating rollers of the tensioning means are movable on command towards or away from each other in order to engage or disengage with respect to the article supported by said supporting means.

14. The apparatus according to claim 1, further comprising article orientating means which are adapted to turn the article about its own axis on said supporting means.

15. The apparatus according to claim 14, wherein said orientating means comprise a pair of narrow belts which face each other with one of their portions and are arranged above said first passage, said narrow belts being engageable, thanks to their facing portions, with the two opposite sides of said border and being actuatable with opposite directions of advancement of their facing portions so as to produce a rotation of the article about its own axis.

16. The apparatus according to claim 15, further comprising detection means for detecting at least one reference region arranged on said border, said detection means being operatively connected to said orientating means in order to exclude or interrupt the actuation of said orientating means when said reference region is detected.

17. The apparatus according to claim 15, wherein said narrow belts are movable on command towards or away from each other in order to engage or disengage said border.

18. The apparatus according to claim 14, wherein said orientating means comprise a pair of swords which protrude substantially vertically above said supporting means, said swords being movable on command along a substantially vertical direction in order to enter, with their lower end, the axial end of the article with said border or slide out of said axial end of the article, and being movable on command towards or away from each other in a direction which is substantially parallel to the longitudinal extension of said first slit-like passage in order to engage or disengage inside said axial end of the article with said border.

19. A method for automatically feeding tubular articles, particularly hosiery, to a sewing machine which is adapted to close the tubular articles at one of their axial ends, comprising the steps of:

fitting an axial end of an article, provided with a border which is thicker than at least one adjacent portion of the article, on grip means which can be actuated in order to engage said axial end so as to support said article and produce a spacing of two diametrically opposite regions of said axial end transversely to an axial extension of the article;

supporting said article in a substantially vertical arrangement by virtue of said grip means, with the axial end of the article engaged by said grip means arranged above the remaining part of the article;

inserting a portion of the article, arranged below said border, in a first slit-like passage which is formed by means for supporting the article and is narrower than the overall thickness of said border; tensioning in a downward direction the article inserted in said first slit-like passage; inserting the portion of the article located directly below said border, with the article thus supported and tensioned, along a second slit-like passage arranged substantially horizontally and formed between the pair of feeder guides of a sewing machine.

20. The method according to claim 19, wherein said article, before insertion in said second slit-like passage, is subjected to rotation about its own axis in order to position it correctly for a subsequent sewing operation.

* * * * *